US011771609B2

(12) United States Patent
Grindstaff et al.

(10) Patent No.: US 11,771,609 B2
(45) **Date of Patent: *Oct. 3, 2023**

(54) PATIENT POSITIONING SYSTEM

(71) Applicant: DeRoyal Industries, Inc., Powell, TN (US)

(72) Inventors: Rex Allen Grindstaff, Knoxville, TN (US); Angela J. Schubert, Knoxville, TN (US); Ethan Edward Valentine, Knoxville, TN (US)

(73) Assignee: DeRoyal Industries, Inc., Powell, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/747,527

(22) Filed: May 18, 2022

(65) Prior Publication Data

US 2022/0273511 A1 Sep. 1, 2022

Related U.S. Application Data

(63) Continuation of application No. 17/068,091, filed on Oct. 12, 2020, now Pat. No. 11,364,166.

(51) Int. Cl.

| | |
|---|---|
| ***A61G 7/10*** | (2006.01) |
| ***A61G 13/12*** | (2006.01) |
| ***A47C 27/14*** | (2006.01) |

(52) U.S. Cl.

CPC ..... *A61G 7/1057* (2013.01); *A47C 27/14* (2013.01); *A61G 13/121* (2013.01); *A61G 13/126* (2013.01); *A61G 2200/32* (2013.01)

(58) Field of Classification Search

CPC ..... A61G 1/01; A61G 7/065; A61G 7/1057; A61G 7/1023; A61G 7/1235; A61G 7/121; A61G 7/126; A61G 2200/32; A61F 5/3273; A61F 5/373; A47C 27/14

See application file for complete search history.

(56) References Cited

U.S. PATENT DOCUMENTS 11,364,166 B2 * 6/2022 Grindstaff ..... A61G 13/12

* cited by examiner

*Primary Examiner* — Robert G Santos
*Assistant Examiner* — Adam C Ortiz
(74) *Attorney, Agent, or Firm* — Luedeka Neely Group, PC

(57) ABSTRACT

A patient positioning system configured for positioning and supporting a patient against movement, the positioning system comprising: an arm positioner configured to be positionable about an arm of the patient. The arm positioner has a triangular wedge with a planar base and an angled leg, an end of the triangular wedge of the arm positioner is located to extend between the base of the arm positioner and the angled leg of the arm positioner and configured to abut the arm of the patient. An upper flexible flap extends away from the angled leg of the arm positioner adjacent the end of the triangular wedge; and a lower flexible flap extends away from the base of the arm positioner adjacent the end of the triangular wedge. The upper flexible flap and the lower flexible flap are configured to be oppositely wrapped around the arm of the patient to snugly envelope the arm and secure it relative to the triangular wedge.

7 Claims, 8 Drawing Sheets

PATIENT POSITIONING SYSTEM

FIELD

The present disclosure relates to devices for positioning and restraining patients. More particularly, the disclosure relates to a patient positioning system for positioning a patient on an operating table in a steep Trendelenburg position or like steep position and to better support the patient on the table and prevent slipping or movement of the patient relative to the operating table.

BACKGROUND

Improvement is desired in devices for positioning and restraining patients on an operating room table. In particular, improvement is needed in devices for positioning a patient on an operating table in multiple Trendelenburg positions or Lateral Oblique positions. In these positions the patient is maintained at a steep angle greater than about 30 degrees. These positions are desirable for various medical procedures.

In the Trendelenburg position, the patient is flat on the operating table and the table is angled along its length axis so that the feet of the patient are vertically higher than the head of the patient.

The Reverse Trendelenburg position is the same, except the table is angled so that the head of the patient is vertically higher than the feet of the patient.

In Lateral Oblique positions the patient is positioned on the table to be tilted laterally to one side.

As will be appreciated, it becomes difficult to securely restrain a patient against movement and in a desired position in steep angle positions.

SUMMARY

The above and other needs are met by a patient positioning system configured for positioning and supporting a patient against movement on an operating table.

In one aspect, a patient positioning system according to the disclosure includes a positioning pad including a pad having handles connected thereto for lifting of the positioning pad. The positioning pad is configured to be lifted when the patient is positioned to lie on the positioning pad.

The system also includes a pair of scapular wedges each configured to be positionable on the positioning pad to underlie a scapula of the patient when the patient is lying on the positioning pad. Each of the scapular wedges having a planar base positionable on an upper surface of the positioning pad and an angled leg.

The system also has a head positioner configured to be positionable on the positioning pad to support a head and neck of the patient when the patient is lying on the positioning pad. The head positioner has a planar base positionable on the upper surface of the positioning pad, an inclined neck trough angled upwardly from the planar base of the head positioner, and an uppermost portion of the inclined neck trough meeting and merging with a generally horizontal head trough.

The system also includes a pair of arm positioners each configured to be positionable on the positioning pad about an arm of the patient when the patient is lying on the positioning pad. Each of the arm positioners has a triangular wedge with a planar base positionable to sit on the upper surface of the positioning pad and an angled leg. An end of the triangular wedge of the arm positioner is located to extend between the base of the arm positioner and the leg of the arm positioner and configured to abut the arm of the patient. An upper flexible flap extends away from the angled leg of the arm positioner adjacent the end of the triangular wedge of the arm positioner; and a lower flexible flap extends away from the base of the arm positioner adjacent the end of the triangular wedge of the arm positioner. The upper flexible flap and the lower flexible flap of the arm positioner are configured to be oppositely wrapped around the arm of the patient to snugly envelope the arm and secure it relative to the triangular wedge of the arm positioner.

In another aspect, a positioning system according to the disclosure includes a pair of scapular wedges each configured to be positionable to underlie a scapula of the patient when the patient is lying on the operating table, each of the scapular wedges having a planar base and an angled leg.

A head positioner is included in the system and configured to support a head and neck of the patient when the patient is lying on the operating table. The head positioner has a planar base positionable, an inclined neck trough angled upwardly from the planar base of the head positioner, and an uppermost portion of the inclined neck trough meeting and merging with a generally horizontal head trough.

The system also has a pair of arm positioners each configured to be positionable about an arm of the patient when the patient is lying on the operating table. Each of the arm positioners has a triangular wedge with a planar base and an angled leg. An end of the triangular wedge of the arm positioner is located to extend between the base of the arm positioner and the leg of the arm positioner and configured to abut the arm of the patient.

An upper flexible flap of the arm positioner extends away from the angled leg of the arm positioner adjacent the end of the triangular wedge of the arm positioner; and a lower flexible flap of the arm positioner extends away from the base of the arm positioner adjacent the end of the triangular wedge of the arm positioner. The upper flexible flap and the lower flexible flap are configured to be oppositely wrapped around the arm of the patient to snugly envelope the arm and secure it relative to the triangular wedge of the arm positioner.

In a further aspect of the disclosure, there is disclosed a patient positioning system configured for positioning and supporting a patient against movement.

The positioning system includes an arm positioner configured to be positionable about an arm of the patient. The arm positioner has a triangular wedge with a planar base and an angled leg, an end of the triangular wedge of the arm positioner is located to extend between the base of the arm positioner and the angled leg of the arm positioner and configured to abut the arm of the patient.

An upper flexible flap extends away from the angled leg of the arm positioner adjacent the end of the triangular wedge; and a lower flexible flap extends away from the base of the arm positioner adjacent the end of the triangular wedge. The upper flexible flap and the lower flexible flap are configured to be oppositely wrapped around the arm of the patient to snugly envelope the arm and secure it relative to the triangular wedge.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
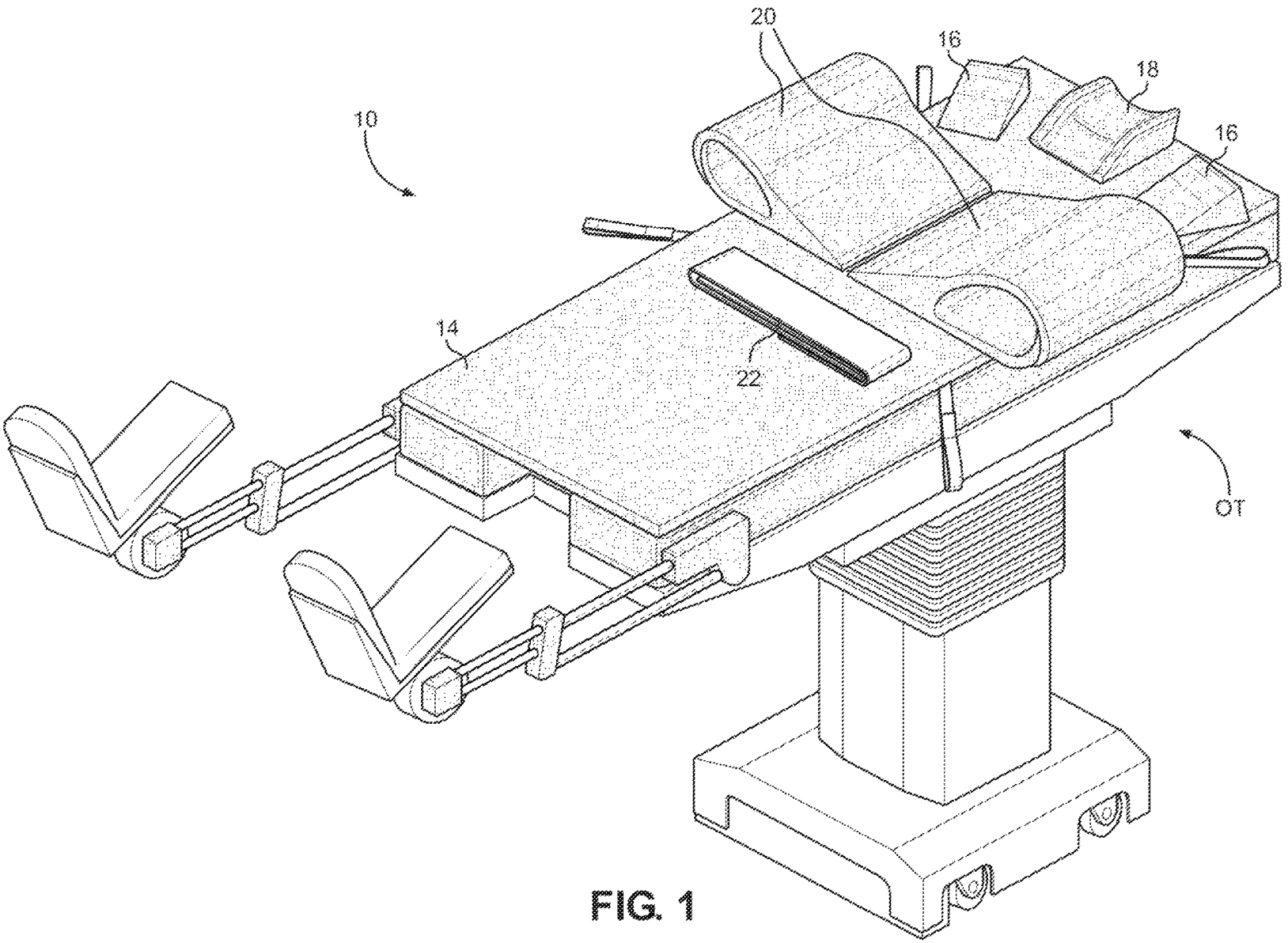
FIG. 1 is a perspective view showing a patient positioning system according to the disclosure installed on an operating table.
Figure 2:
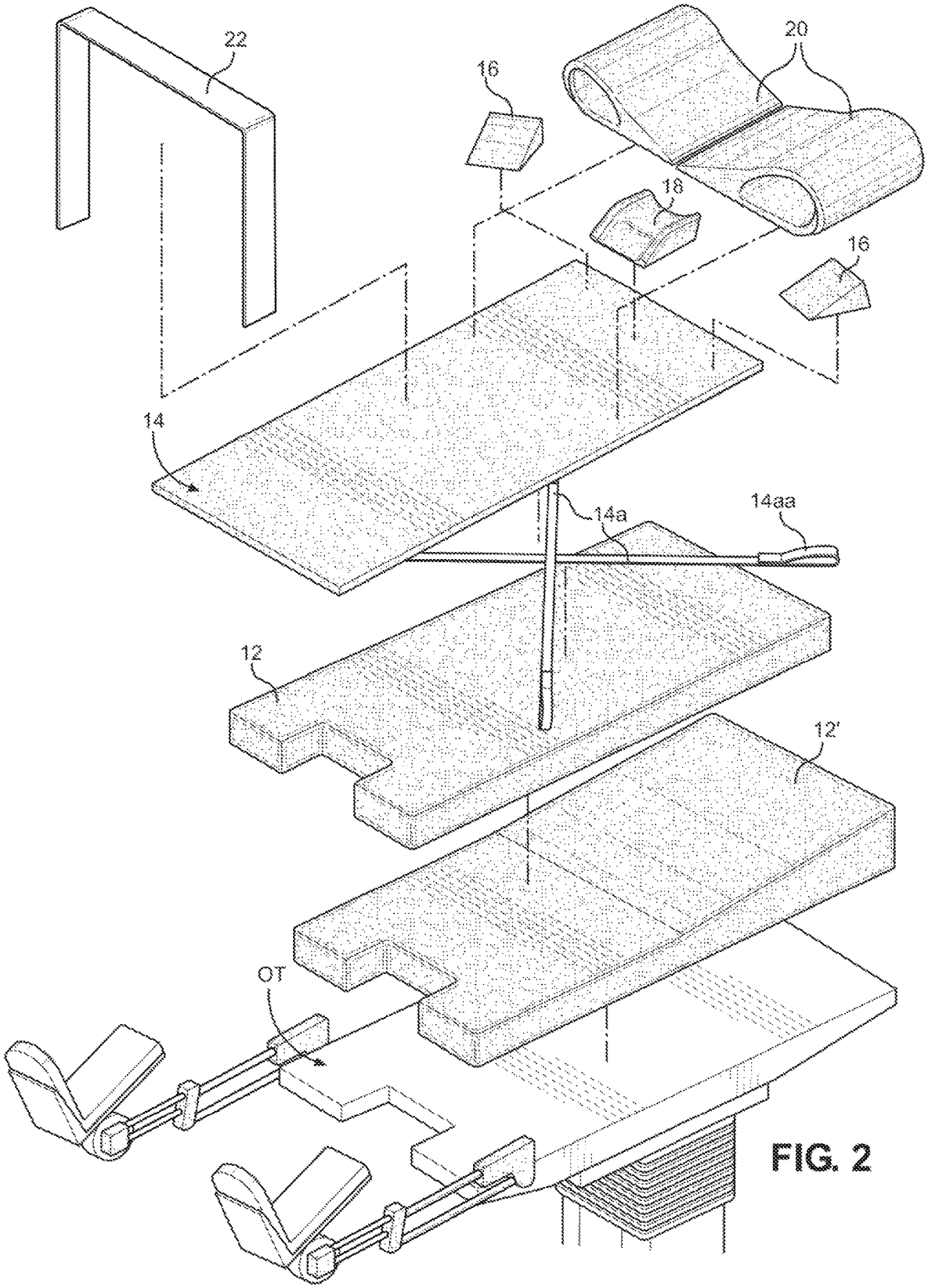
FIG. 2 is an exploded view of FIG. 1.

With initial reference to FIGS. 1 and 2, the disclosure relates to a patient positioning system 10 configured for positioning and supporting a patient P. The system 10 is particularly configured for supporting the patient P against movement on an operating table OT, including when the operating table OT is oriented to position the patient P at a steep angle.

In a preferred embodiment, the positioning system 10 includes a flat mattress pad base 12 or an angled mattress pad base 12', a positioning pad 14, a pair of scapular wedges 16, a head positioner 18, a pair of arm positioners 20, and a body strap 22. It will be appreciated that any of the components can be used alone to position a patient. However, the use of all of the components has been observed to yield the most stability against movement.

The operating table OT is a conventional operating table of the type configured to enable multiple Trendelenburg positions or Lateral Oblique positions characterized by the operating table OT positioned to orient the patient P at a steep angle greater than about 30 degrees.

Figure 3:
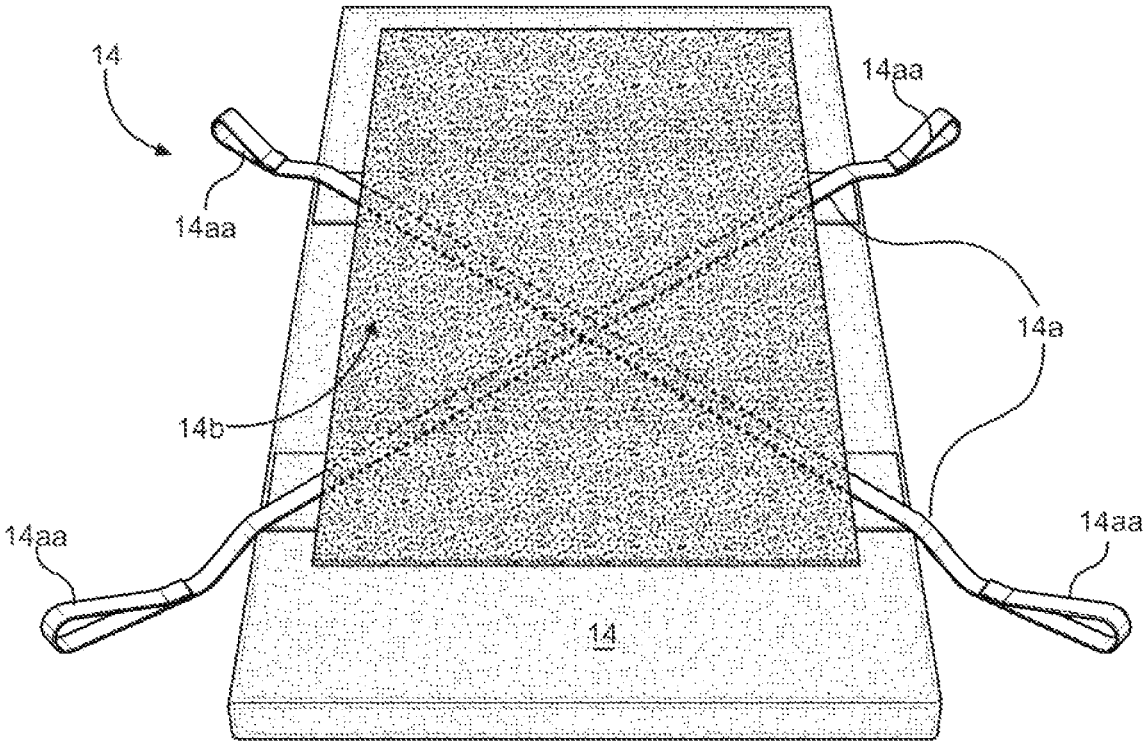
FIGS. 3-4 show a positioning pad component of the patient positioning system.

With continued reference to FIGS. 1 and 2 and with additional reference to FIG. 3, the flat mattress pad base 12 may be placed on top of the operating table OT in replacement of a conventional mattress of the operating table OT. The pad base 12 has an interior mattress or padding, preferably a flexible high-density polyurethane foam, encased in a covering 12*a*. The covering 12*a* is a flexible sheet material having a rugous texture 12*b* on the bottom surface thereof to provide a high coefficient of friction surface for resistance to sliding relative to the operating table OT. The top surface of the covering also has a rugous texture 12*c* to provide a high coefficient of friction to cooperate with the positioning pad 14, as described below in connection with FIGS. 6A and 6B. All exterior surfaces of the covering may be of the same rugous texture for ease of manufacture. The pad base 12 may include a cutout 12*d* at the foot end to conform to a foot end of the operating table OT. In this regard, it will be understood that the pad base 12 may be of universal sizing to fit a variety of operating tables or custom configured for a specific operating table.

The angled mattress pad base 12' is made of the same materials as the pad base 12, except it is configured to have an angled profile to elevate an upper body portion of a patient. This configuration may be desirable for use with obese patients and patients having compromised breathing, and may reduce the effects of physiological funneling and increases in intraocular pressure in steep head down positions.

Figure 4:
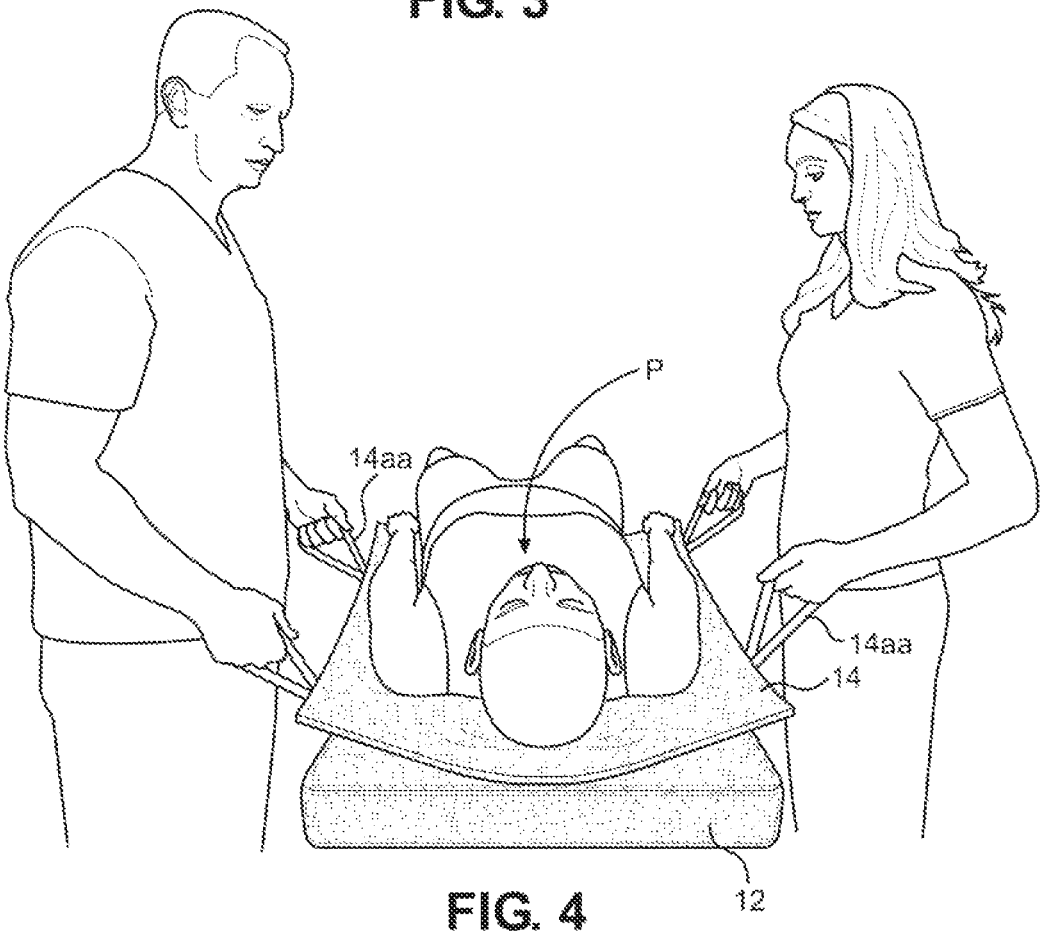

With reference to FIGS. 3 and 4, the positioning pad 14 is configured to be located on top of the pad base 12 or 12'. However, it will be understood that the positioning pad 14 may be used directly on the operating table OT or a conventional mattress of the operating table OT or other patient support surface such as a bed. The positioning pad 14 may be made of a flexible high-density polyurethane foam and includes a pair of cross straps 14*a* having handles 14*aa* on the ends thereof. The straps 14*a* are centrally secured adjacent a bottom of the pad 14 so that the straps 14*a* cross at the center of the pad 14 and locate the handles 14*aa* at spaced apart locations on the sides of the pad 14 for lifting and moving of a patient located on the pad 14, as shown in FIG. 4.

Figure 5:
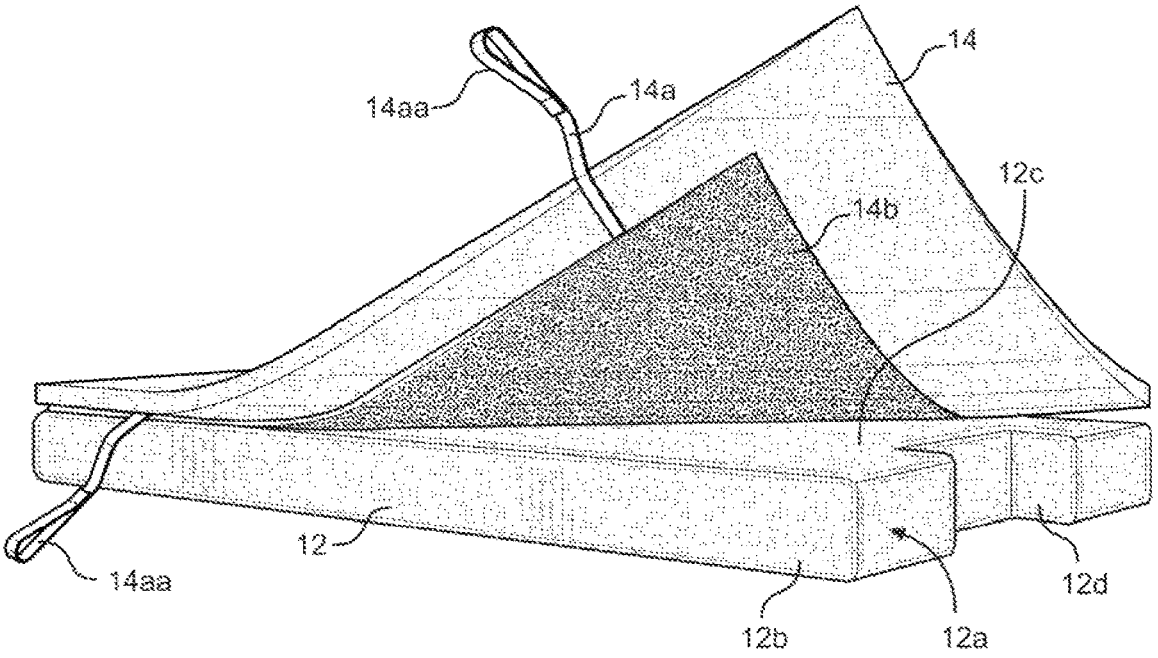
FIGS. 5-6B show the positioning pad and how it frictionally interacts with a mattress pad base of the positioning system.
Figure 6A:
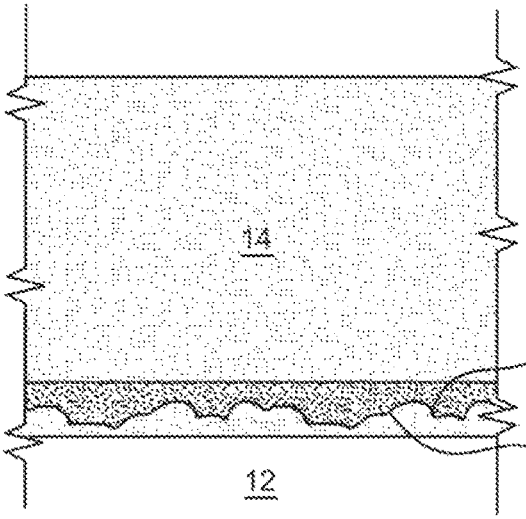
Figure 6B:
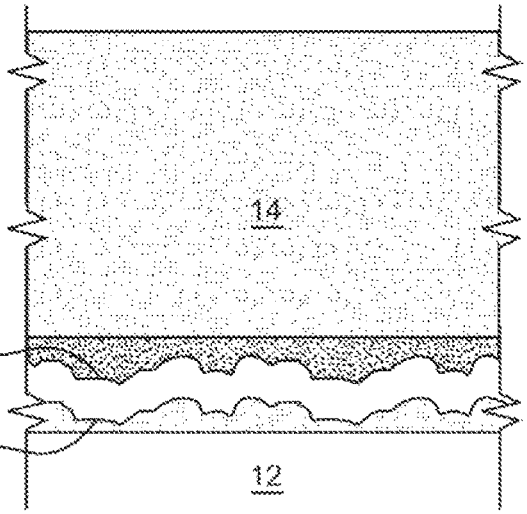

A non-skid pad material 14*b* having a rugous surface is secured to the bottom of the pad 14 over the straps 14*a*. The pad material 14*b* may be secured as by thermal bonding, adhesive, spray coating, or the like. The non-skid material 14*b* reduces relative sliding movement of the pad 14 relative to an underlying surface. In particular, as shown in FIGS. 5 and 6A-6B, the non-skid material 14*b* is particularly configured to frictionally mesh with the rugous texture 12*c* of the covering 12*a* of the top surface of the pad base 12 to provide increased surface areas for contact to inhibit relative movement therebetween. The non-skid pad material 14*b* may be located under the entirety of the bottom of the pad 14. However, to facilitate trimming of the pad 14 as may be desired in certain circumstances, the non-skid material 14*b* may just be located on the central majority of the pad 14 leaving the ends of the pad 14 without the non-skid material 14*b* to facilitate trimming away of some of the material of the pad 14.

Figure 7A:
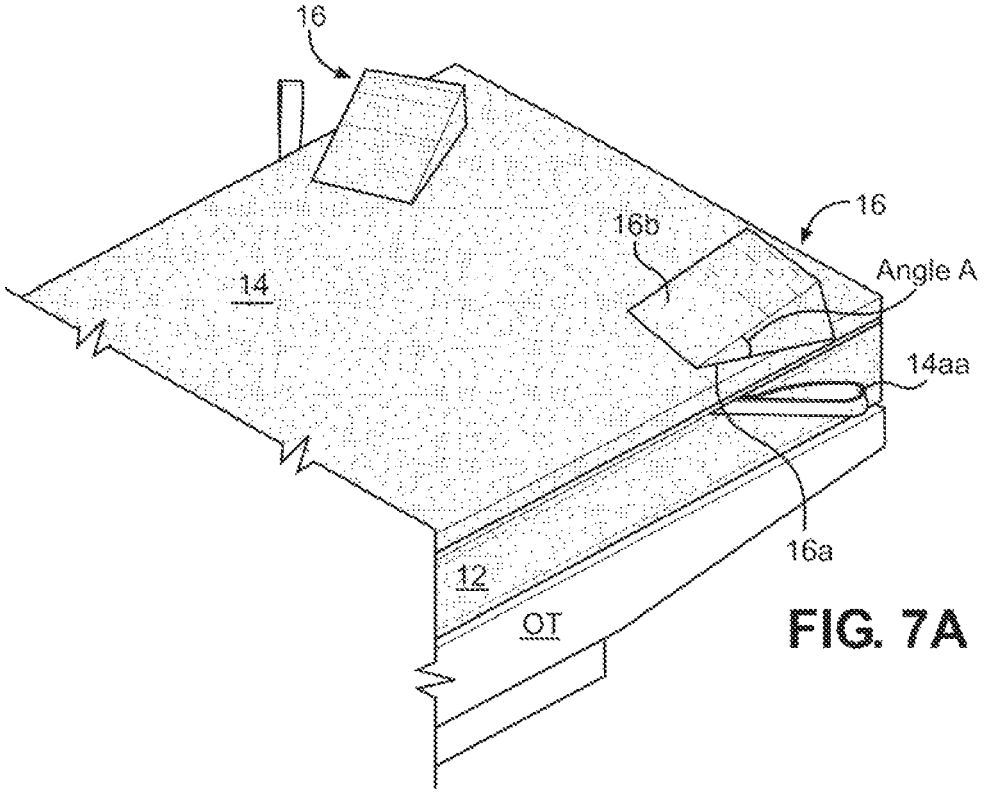
FIGS. 7A-7B show scapular wedge components of the patient positioning system.
Figure 7B:
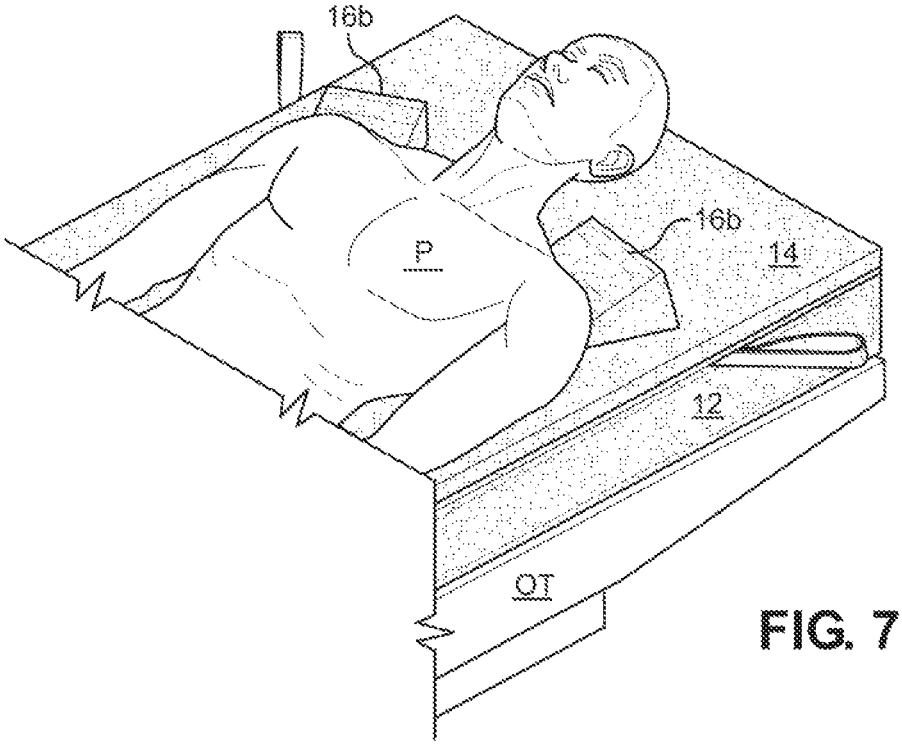

With reference to FIGS. 1 and 2, and additional reference to FIGS. 7A-7B, the scapular wedges 16 are each made of a flexible high-density polyurethane foam and are generally triangular-shaped. Each of the wedges 16 has a planar base 16*a* that sits on the upper surface of the pad 14 and an angled leg 16*b* that is angled upwardly from the base 16*a* at an angle A of from about 15 degrees to about 45 degrees, most preferably about 30 degrees. The scapular wedges 16 are desirably positioned on either side of the back of the patient so that the angled leg 16*b* of each wedge 16 underlies the scapula or shoulder blade of the patient and supports the patient in a manner to reduce pressure on the spinal cord. In particular, it has been observed that the scapular wedges 16 help to reduce pressure applied to nerves of the spinal cord such as the brachial plexus, which is a group of nerves that come from the spinal cord in the neck and travel down the arm.

Figure 8A:
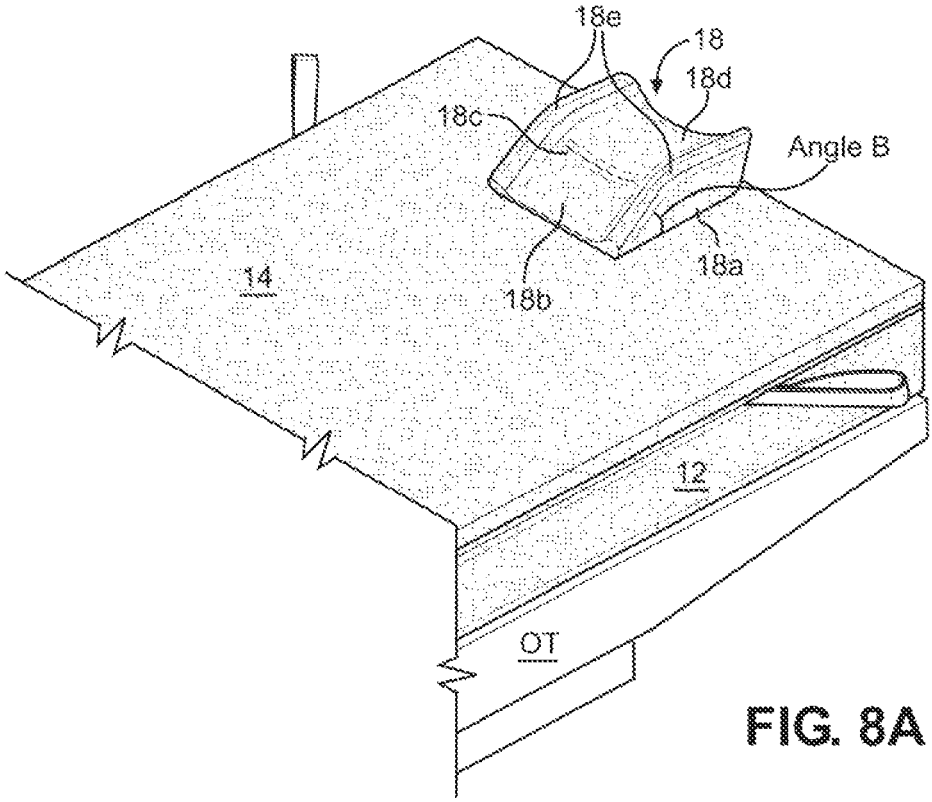
FIGS. 8A-8B show a head positioner component of the patient positioning system.
Figure 8B:
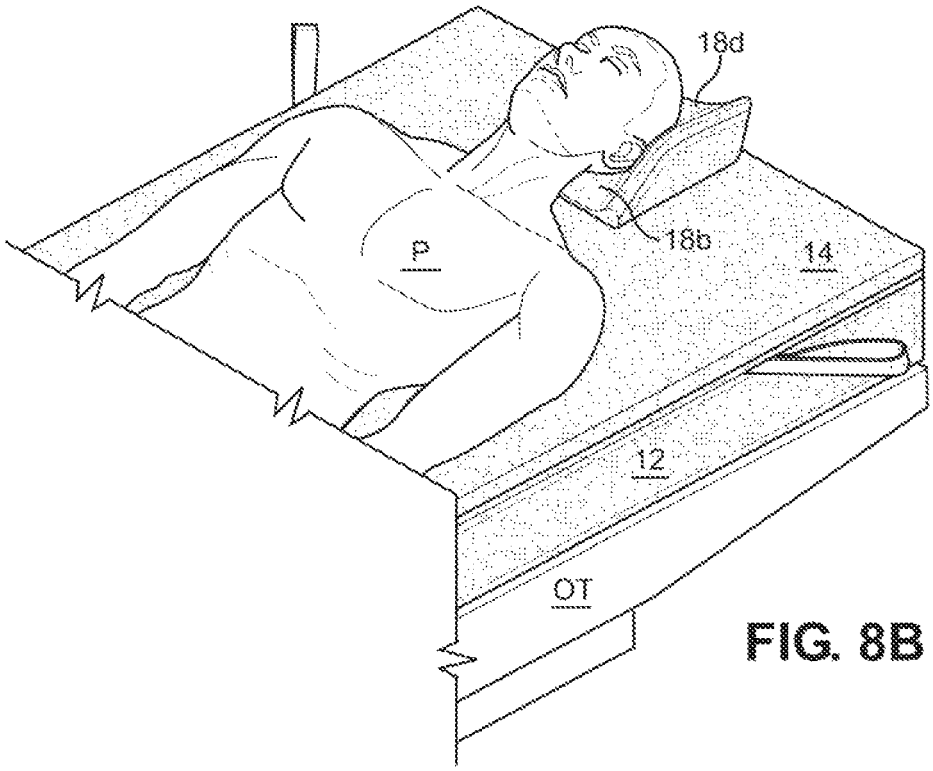

With reference to FIGS. 1 and 2, and additional reference to FIGS. 8A-8B, the head positioner 18 is made of a flexible high-density polyurethane foam and configured to receive the neck and head of the patient. The head positioner 18 has a planar base 18*a* that sits on the upper surface of the pad 14. An inclined neck trough 18*b* is angled upwardly from the base 18*a* at an angle B of from about 30 degrees to about 60 degrees, most preferably about 45 degrees. An uppermost portion of the inclined neck trough 18*b* transitions to provide a smooth curve 18*c* that meets and merges with a generally horizontal head trough 18*d*. The neck trough 18*b* cradles the neck of the patient and the head trough 18*d* cradles the head of the patient. The trough shape of the head positioner 18 includes a pair of upstanding walls 18*e* that extend along the opposite sides of the head positioner 18 to further stabilize the neck and head of the patient P. Together, these features cooperate to provide desired and stable positioning of the head and neck of the patient.

Figure 9A:
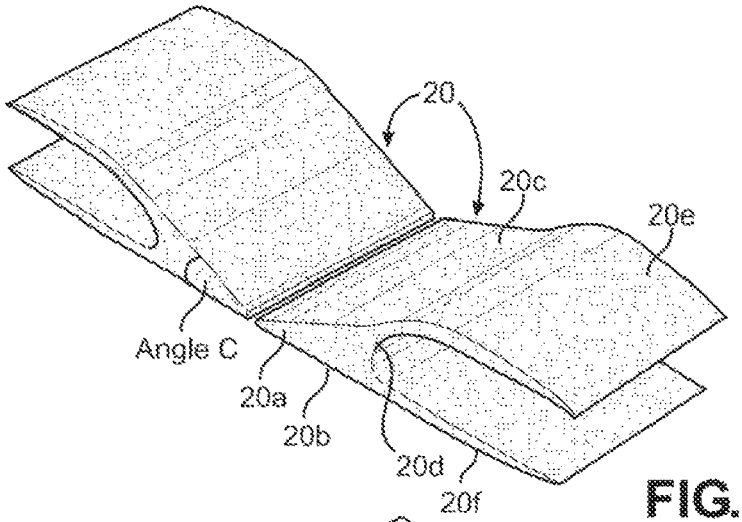
FIGS. 9A-9C show arm positioner components of the patient positioning system.
Figure 9B:
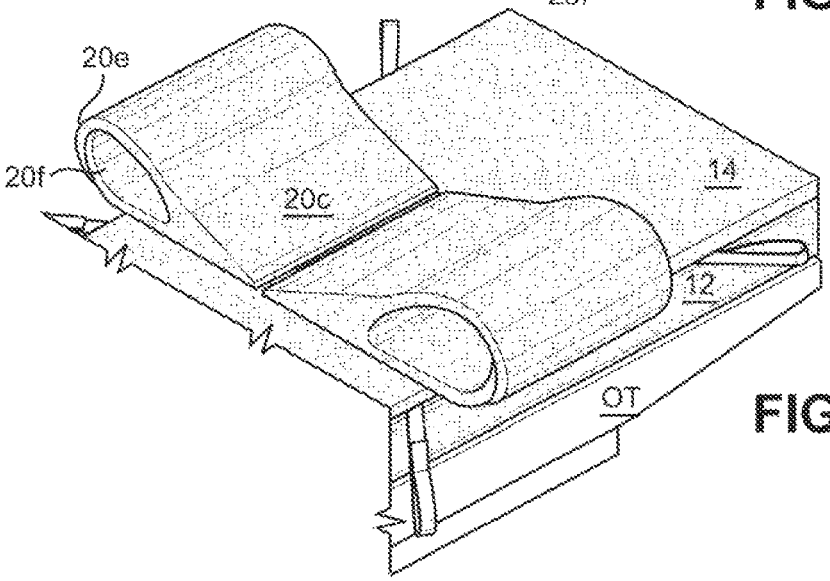
Figure 9C:
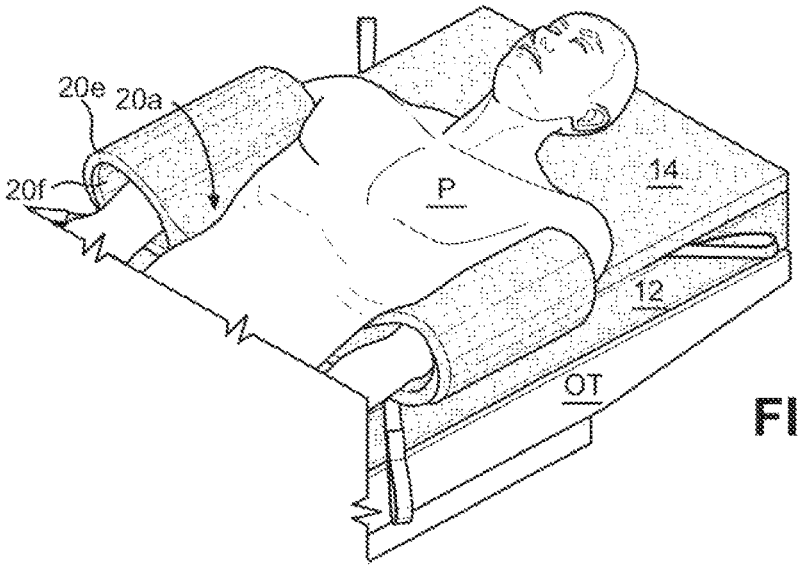

With reference to FIGS. 1 and 2, and additional reference to FIGS. 9A-9C, the arm positioners 20 are each made of a flexible high-density polyurethane foam and configured to encase the arm and desirably position the arm and anchor it against movement. The arm positioners 20 also advantageously serve to support the sacrum at the base of the spine and offload pressure from the sacrum. The arm positioners 20 advantageously fix the arms of the patient P along the sides of the body of the patient and interface with the body of the patient P to stabilize the patient P against movement.

Each arm positioner 20 has a triangular wedge 20*a* having a planar base 20*b* that sits on the upper surface of the pad 14 and an angled leg 20*c* that is angled upwardly from the base 20*b* at an angle C of from about 10 degrees to about 30 degrees, most preferably about 20 degrees. A generally vertical end 20*d* of the wedge 20*a* is located to extend between the base 20*b* and the leg 20*c* and configured as a concave surface to abut an arm of the patient. An upper flexible flap 20*e* extends away from the angled leg 20*c* adjacent the vertical end 20*d*. A lower flexible flap 20*f* extends away from the base 20*b* adjacent the vertical end 20*d*. The upper flexible flap 20*e* and the lower flexible flap 20*f* are configured to be oppositely wrapped around the arm of the patient to snugly envelope the arm and secure it relative to the triangular wedge 20*a* of the arm positioner 20. Mating hook and loop or other fasteners may be utilized to maintain the flaps 20*e* and 20*f* about the arm.

To install the arm positioner 20 onto one of the arms of the patient, the arm is located adjacent the concave surface of the vertical end 20*d* and the flaps 20*e* and 20*f* are snugly wrapped around the arm and secured to one another as by hook and loop material. The wedge 20*a* is then positioned to extend under the patient P so that the angled leg 20*c* supports the sacrum at the base of the spine of the patient P. This is done for each arm such that the sacrum is supported on either side by the wedges 20*a* of each of the arm positioners 20. As installed, the arm positioners 20 are restrained from movement by the weight of the patient P in conjunction with the frictional resistance provided by the shape of the wedges 20*a*. Likewise, the patient P is restrained against movement, including the arms of the patient P.

Figure 10A:
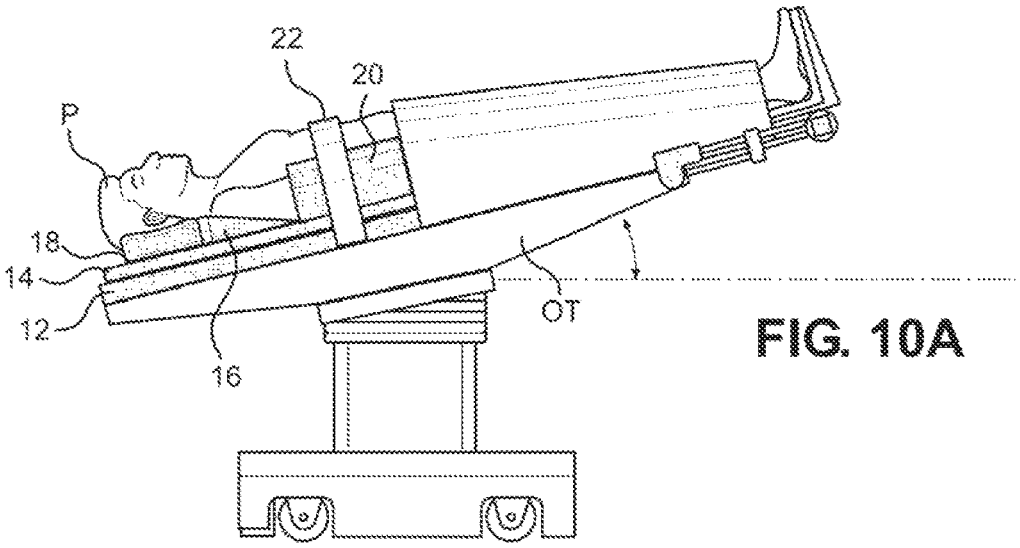
FIGS. 10A-10C depict use of the patient positioning system in various steep angle surgical procedures.
Figure 10B:
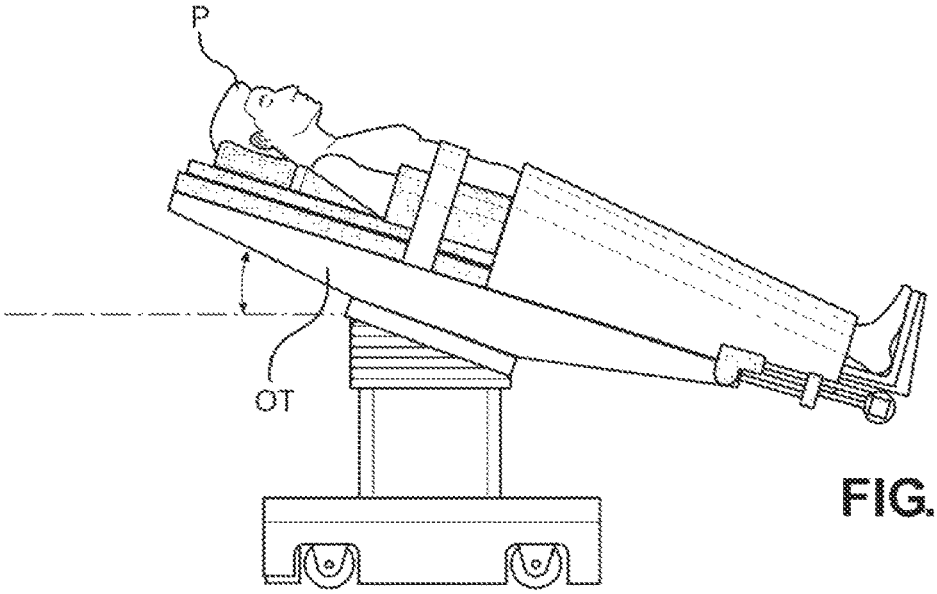
Figure 10C:
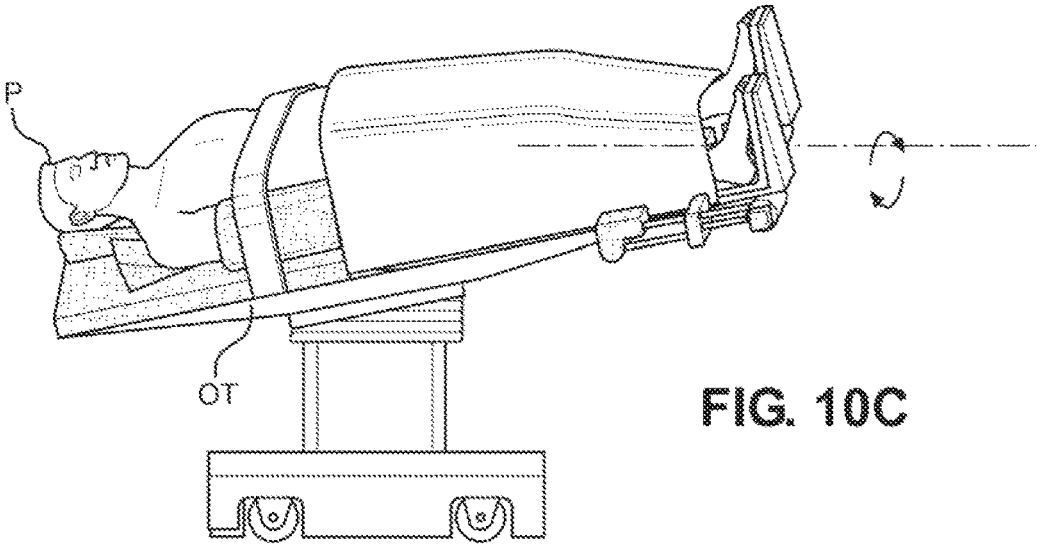

Once the patient P is securely and desirably positioned using the scapular wedges 16, the head positioner 18, and the arm positioners 20, the body strap 22 is secured around the patient P, preferably around the arm positioners 20 and the operating table OT to further secure the patient against movement. As depicted in FIGS. 10A-10C, the positioning system 10 is effective to secure the patient P against movement in multiple steep angle positions, such as Trendelenburg positions or Lateral Oblique positions in which the patient P is oriented at a steep angle greater than about 30 degrees.

It has been observed that the patient positioning system 10 substantially increases the points of frictional contact of the patient P by increasing the percentage of body surface contact and providing multiple locations for frictionally fixing the body of the patient P against movement and distributing the body weight of the patient to bear on these locations to more tightly secure the patient in a desired position.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A patient positioning system configured for positioning and supporting a patient against movement on an operating table, the positioning system comprising:

a pair of scapular wedges each configured to be positionable to underlie a scapula of the patient when the patient is lying on the operating table, each of the scapular wedges having a planar base and an angled leg;

a head positioner configured to support a head and neck of the patient when the patient is lying on the operating table, the head positioner having a planar base positionable, an inclined neck trough angled upwardly from the planar base of the head positioner, and an uppermost portion of the inclined neck trough meeting and merging with a generally horizontal head trough; and a pair of arm positioners each configured to be positionable about an arm of the patient when the patient is lying on the operating table, each of the arm positioners having a triangular wedge with a planar base and an angled leg, an end of the triangular wedge of the arm positioner is located to extend between the base of the arm positioner and the leg of the arm positioner and configured to abut the arm of the patient to position and anchor the arm against movement and to support a sacrum of the patient at a base of a spine of the patient and offload pressure from the sacrum; an upper flexible flap extending away from the angled leg of the arm positioner adjacent the end of the triangular wedge of the arm positioner; and a lower flexible flap extending away from the base of the arm positioner adjacent the end of the triangular wedge of the arm positioner, the upper flexible flap and the lower flexible flap configured to be oppositely wrapped around the arm of the patient to snugly envelope the arm and secure it relative to the triangular wedge of the arm positioner.

2. The patient positioning system of claim 1, wherein the angled leg of the scapular wedge is angled upwardly from the planar base of the scapular wedge at an angle of from about 15 degrees to about 45 degrees.

3. The patient positioning system of claim 1, wherein the inclined neck trough of the head positioner is angled upwardly from the planar base of the head positioner at an angle of from about 30 degrees to about 60 degrees.

4. The patient positioning system of claim 1, wherein the angled leg of the arm positioner is angled upwardly from the base of the arm positioner at an angle of from about 10 degrees to about 30 degrees.

5. The patient positioning system of claim 1, wherein the end of the triangular wedge of the arm positioner is configured as a concave surface.

6. A patient positioning system configured for positioning and supporting a patient against movement, the positioning system comprising: an arm positioner configured to be positionable about an arm of the patient, the arm positioner having a triangular wedge with a planar base and an angled leg, an end of the triangular wedge of the arm positioner is located to extend between the base of the arm positioner and the angled leg of the arm positioner and configured to abut the arm of the patient to position and anchor the arm against movement and to support a sacrum of the patient at a base of a spine of the patient and offload pressure from the sacrum; an upper flexible flap extending away from the angled leg of the arm positioner adjacent the end of the triangular wedge; and a lower flexible flap extending away from the base of the arm positioner adjacent the end of the triangular wedge, the upper flexible flap and the lower flexible flap configured to be oppositely wrapped around the arm of the patient to snugly envelope the arm and secure it relative to the triangular wedge.

7. The system of claim 6, wherein the end of the triangular wedge is configured as a concave surface.

* * * * *